US005346095A

United States Patent [19]

Deal

[11] Patent Number: 5,346,095

[45] Date of Patent: Sep. 13, 1994

[54] BEVERAGE CAN

[76] Inventor: Richard E. Deal, 614 S. Moore, Algona, Iowa 50511

[21] Appl. No.: 69,623

[22] Filed: Jun. 1, 1993

[51] Int. Cl.[5] ..... B65D 7/42

[52] U.S. Cl. ..... 220/669; 220/660; 220/DIG. 13; 220/914; 220/906

[58] Field of Search ..... 220/669, 674, 660, 662, 220/DIG. 13, 914, 906

[56] References Cited

U.S. PATENT DOCUMENTS

| | | |
|---|---|---|
| D. 102,451 | 9/1936 | Schaefer . |
| 214,698 | 4/1879 | Perkins . |
| D. 224,291 | 7/1972 | Mascia . |
| D. 224,382 | 7/1972 | Mascia . |
| D. 224,640 | 8/1972 | Mascia . |
| D. 224,642 | 8/1972 | Mascia . |
| D. 224,644 | 8/1972 | Mascia . |
| D. 227,347 | 6/1973 | Bystedt . |
| D. 227,872 | 7/1973 | Stanley . |
| D. 230,956 | 3/1974 | Bystedt . |
| D. 254,714 | 4/1980 | Mascia et al. . |
| D. 285,534 | 9/1986 | Itoh . |
| 1,559,624 | 9/1925 | Kopp . |
| 3,420,367 | 1/1969 | Carmichael . |
| 3,563,408 | 11/1968 | Bijvoet . |
| 3,759,203 | 9/1973 | Frankenberg . |
| 4,157,762 | 7/1979 | Robinson . |
| 4,185,769 | 1/1980 | Vartia ..... 220/669 |
| 4,860,908 | 8/1989 | Rumble et al. . |
| 4,925,050 | 5/1990 | Yu . |
| 4,938,374 | 7/1990 | Wuchterl . |
| 5,165,557 | 11/1992 | Ota et al. . |

*Primary Examiner*—Joseph Man-Fu Moy

[57] ABSTRACT

An improved beverage can is provided, and has a top wall, a bottom wall, and a side wall extending between and being integrally connected to the top and bottom walls. The side wall has opposing curved portions and opposing flattened or concaved portions. The flattened or concaved portions are oriented for gripping by person's thumb and fingers. One of the flattened or concaved portions is positioned below an opening in the top wall of the can such that the can is automatically oriented for drinking or pouring when grasped by a person. A circular ridge is provided adjacent the top and bottom walls of the can such that the can is rollable along a surface or track. The flattened or concaved portions also provide an advertising panel for the beverage manufacturer or distributors.

13 Claims, 1 Drawing Sheet

BEVERAGE CAN

BACKGROUND OF THE INVENTION

Beverage cans of numerous sizes and shapes have been known for many years for drinks such as pop, beer and juice. The most common beverage can currently used by manufacturers is a 12 ounce cylindrical can having a "pop-top" opening.

In drinking from the conventional 12 ounce cylindrical beverage can having a pop-top opening, one problem is that the can has to be rotated such that the opening is approximately aligned with the drinker's thumb, so that the opening can be easily positioned over the drinker's mouth for consumption of the beverage directly from the can, or with a glass or cup such that the beverage can be poured into the glass or cup. Due to the cylindrical shape of the can, such alignment of the opening with the drinker's mouth, or the cup or glass, cannot be accomplished by touch alone. That is, the user cannot merely grasp the cylindrical side wall of the can and have the opening aligned in the desired position. Rather, the user must visually perceive the opening and align it accordingly.

Another problem with the conventional cylindrical 12 ounce can is the grasping of the can by children or adults with small hands. Also, condensation on the cylindrical side wall can make the can slippery.

Accordingly, a primary objective of the present invention is the provision of an improved beverage can.

Another objective of the present invention is the provision of a beverage can having opposing flattened sides for easy grasping and for aligning the opening of the can in a desired orientation.

Still a further objective of the present invention is the provision of an improved beverage can which can be dispensed from conventional coin-operated beverage machines.

Another objective of the present invention is the provision of a beverage can having a 12 ounce capacity and having structural integrity.

A further objective of the present invention is the provision of an improved beverage can having at least one flattened portion along the side wall.

Yet another objective of the present invention is the provision of an improved beverage can which has a defined-area advertising panel incorporated therein.

These and other objectives will be apparent from the following description of the invention.

SUMMARY OF THE INVENTION

The beverage can of the present invention includes a top wall, a bottom wall, and a side wall extending between the top and bottom walls. The side wall includes opposing flattened portions and opposing curved portions. The flattened portions provide a gripping area for a user's thumb and fingers. The flattened portions also provide a defined-area advertising panel. The can includes a circular rim or ridge extending around the side wall adjacent the upper and lower ends of the flattened portions. The rim permits the can to roll along a surface or track, such that it can be dispensed from conventional beverage machines. The top wall includes a conventional pop-top for opening the can. One of the flattened portions is centrally aligned with the opening in the top wall of the can, such that, upon gripping the can, the opening in the top wall is oriented for drinking or pouring.

DESCRIPTION OF THE PREFERRED EMBODIMENT

Figure 1:
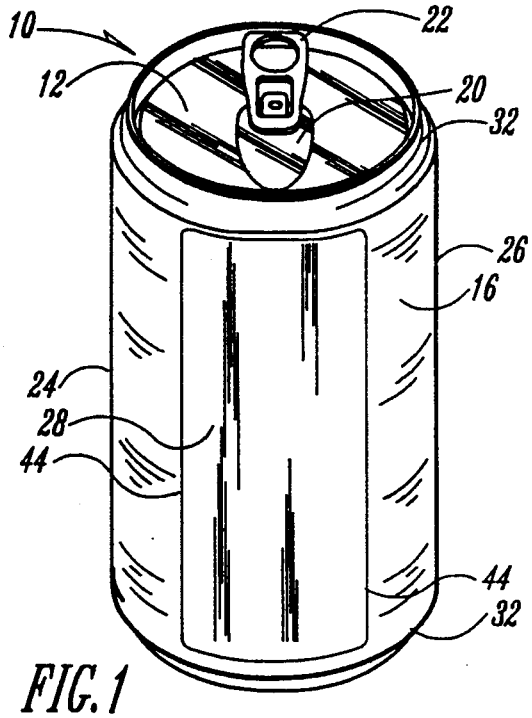
FIG. 1 is a perspective view of the improved beverage can of the present invention.
Figure 2:
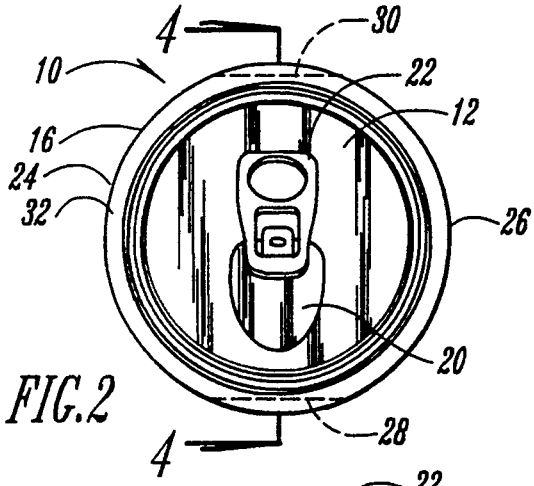
FIG. 2 is a top plan view of the can.
Figure 3:
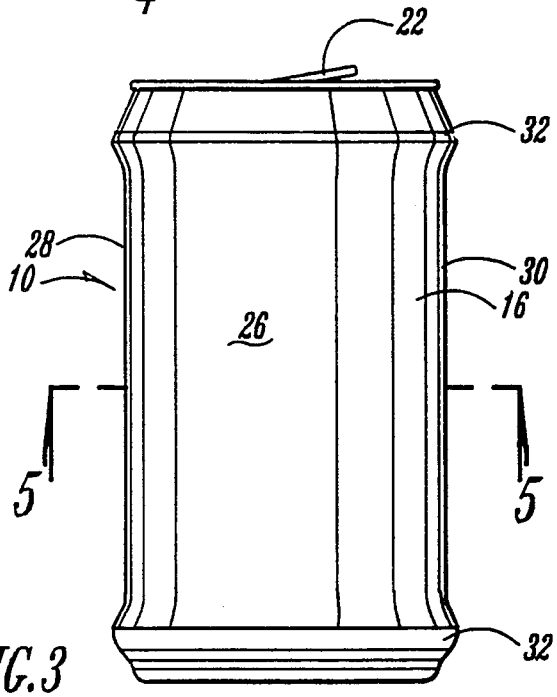
FIG. 3 is a side elevational view of the can.
Figure 4:
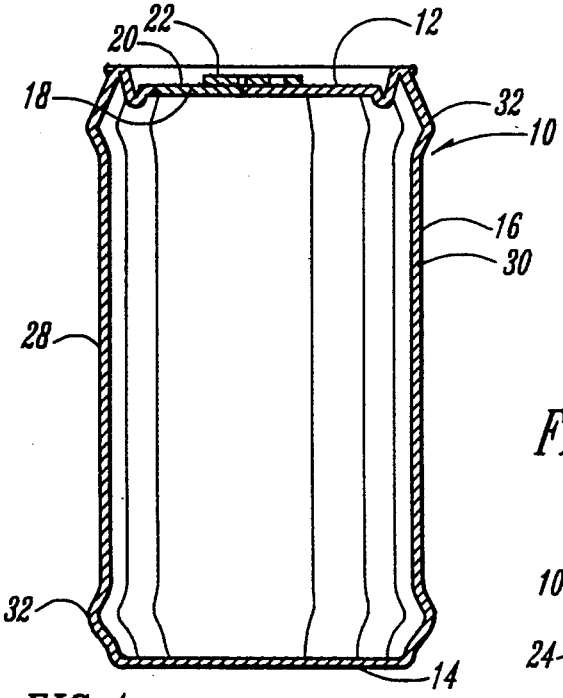
FIG. 4 is a sectional view taken along lines 4—4 of FIG. 2.

The improved beverage can of the present invention is generally designated in the drawings by the reference numeral 10. The can includes a top wall 12, a bottom wall 14, and a continuous side wall 16. Walls 12, 14 and 16 have an integral construction so as to provide a sealed container for beverage within the can 10, such as pop, beer, or juice.

In the drawings, the top wall 12 is shown to have an opening 18 which is normally sealed by a flap 20. Flap 20 can be depressed downwardly into the can by a tab 22 hinged to the top wall 12 of the can 10. The flap and tab form a conventional pop-top opening for the can, and does not constitute a part of the present invention. Other types of openings may also be provided, such as a pull top ring.

The side wall 16 includes opposite curved portions 24 and 26, and opposite flattened portions 28 and 30. The flattened portions 28, 30 extend substantially along the height of the can 10. The flattened portion 28 is centrally positioned below the opening 18. The width of the flattened portions 28, 30 is less than the imaginary chord 31 intersecting the opposite edges of each curved portion 24, 26.

A circular rim or ridge 32 extends around the side wall 16 of the can 10 adjacent the top and bottom walls thereof. Rims 32 have the same curvature, and the same diameter, as curved portions 24, 26. Rims 32 provide a rolling surface for the can, such that the can can be rolled along a surface or track, such as the tracks provided in conventional beverage can dispensing machines. Thus, the improved beverage can 10 of the present invention can be dispensed from conventional beverage machines.

The top wall 12 and bottom wall 14 of the present invention are identical to conventional 12 ounce beverage cans such that the cans can be stacked one upon the other for storage and/or display. Also, cans having the structure of the present invention can be packaged in six-packs using conventional plastic six-pack retainer rings. The improved can 10 is preferably manufactured with dimensions identical to conventional cylindrical 12 ounce cans. Thus, can 10 maintains a 12 ounce capacity and can be easily displayed, stored and stacked with conventional cylindrical cans.

Figure 6:
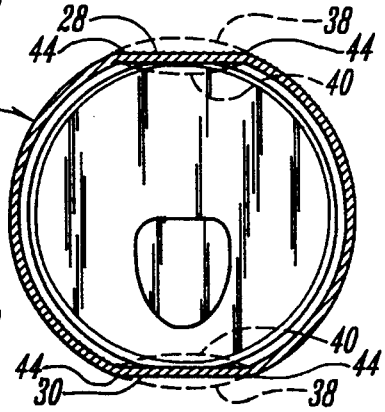
FIG. 6 is a sectional view similar to FIG. 5 showing modified forms of a beverage can.

FIG. 6 shows different forms for the sidewall of a beverage can. The conventional can has a circular sidewall 16. A portion 38 of the sidewall is compressed to form the flattened portion 28. Alternatively, the portion 38 can be indented to form a slightly concave portion 40, 42 as shown in broken lines. The flattening or indentation of portion 38 can be accomplished mechanically or manually. For example, a die (not shown) can be forced over the sidewall 38 to form portion 28 or portion 40. Alternatively, portion 38 may have prestressed edges 44 so that a person can compress portion 38 with his or her hand to form portions 28 or 40.

Figure 5:
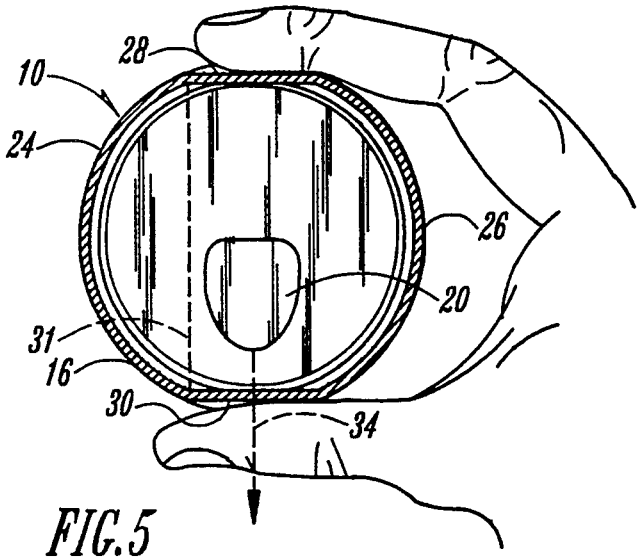
FIG. 5 is a sectional view taken along lines 5—5 of FIG. 3.

In use, a person grasps flattened portion 28 or concave portion 40 with his or her thumb and the flattened portion 30 or concave portion 42 with his or her finger tips, as seen in FIG. 5. With the thumb on the portion 28 or 40, the opening 18 is automatically positioned so that the person can drink directly from the can, or pour the contents of the can into a glass or cup. The flattened portion 28 or concave portion 40 is aligned with a pouring path 34 defined by the opening 18, as shown in FIG. 5. Such positioning of the opening 18 can be accomplished by touch, with little, if any, visual perception of the can. Also, the flattened portions 28, 30, and concave portions 40, 42 provide a specific gripping area for the user. Lastly, the flattened portions 28, 30 and concave portions 40, 42 provide a defined-area advertising panel on which beverage companies can promote the contents of the can, or which can be used as advertising space for special local promotions.

The invention has been shown and described above in connection with the preferred embodiment, and it is understood that many modifications, substitutions and additions may be made which are within the intended broad scope of the invention. From the foregoing, it can be seen that the present invention accomplishes at least all of the stated objectives.

What is claimed is:

1. An improved beverage can comprising:

a top wall with means for selectively opening the can;

a bottom wall;

a substantially cylindrical sidewall extending between and being integrally formed with the top and bottom walls, the sidewall having a pair of opposing curved portions and a pair of opposing flattened portions which form the substantially cylindrical side wall, the flattened portions having upper and lower ends, the flattened portions being oriented for gripping by a person's thumb and fingers for holding the can, and a continuous circular rim adjacent the upper and lower ends of the flattened portions so that the can is rollable along a surface or track.

2. The can of claim 1 further comprising a circular ridge adjacent the top and bottom walls of the can.

3. The can of claim 1 wherein one of the flattened portions is centrally aligned with the opening of the can.

4. The can of claim 1 wherein the flattened portions define advertising panels on the can.

5. The can of claim 1 wherein the flattened portions extend substantially along the height of the sidewall and have upper and lower ends spaced apart from the top and bottom walls.

6. The can of claim 1 wherein the width of each flattened portion is less than the length of a chord extending between the ends of each curved portion.

7. The can of claim 1 wherein the can is normally sealed by the top wall, the bottom wall and the sidewall, and the opening means being operable only one time to open the can to allow the contents to be poured therefrom.

8. An improved beverage can comprising:

a top wall having a normally closed access opening therein defining a pouring path for the beverage;

a bottom wall spaced apart from the top wall; and a substantially cylindrical sidewall extending between the top and bottom walls, the sidewall having a curved portion and a first deformed portion aligned with a vertical plane extending through the pouring path, the sidewall further having a pair of spaced apart circular rims extending circumferentially around the can such that the can is rollable along the rims.

9. The can of claim 8 wherein the first deformed portion is adapted for engagement by a person's thumb.

10. The can of claim 8 further comprising a second deformed portion in the sidewall opposite the first deformed portion.

11. The can of claim 10 wherein the first and second deformed portions are adapted for engagement by a person's thumb and fingers, respectively.

12. The can of claim 8 wherein the first deformed portion is between the rims.

13. The can of claim 8 wherein the first deformed portion defines an advertising panel on the can.

* * * * *